US006554446B1

(12) United States Patent
Walsh et al.

(10) Patent No.: US 6,554,446 B1
(45) Date of Patent: Apr. 29, 2003

(54) STEP ILLUMINATION APPARATUS

(75) Inventors: Terrence C. Walsh, Coto de Caza, CA (US); Randy G. Valparaiso, Whittier, CA (US)

(73) Assignee: Targetti-Tivoli Inc., Santa Ana, CA (US)

( * ) Notice: Subject to any disclaimer, the term of this patent is extended or adjusted under 35 U.S.C. 154(b) by 0 days.

(21) Appl. No.: 09/476,951

(22) Filed: Jan. 3, 2000

(51) Int. Cl.[7] ..... F21S 8/00

(52) U.S. Cl. ..... 362/146; 362/145; 362/131; 362/800; 52/179; 52/182

(58) Field of Search ..... 362/146, 145, 362/131, 282, 800; 52/179, 182

(56) References Cited

U.S. PATENT DOCUMENTS 1,509,211 A * 9/1924 Kausal ..... 362/290
1,820,797 A * 8/1931 Hamilton et al. ..... 362/131
2,865,438 A * 12/1958 Machielse ..... 297/217.6
5,430,627 A * 7/1995 Nagano ..... 362/146
5,904,017 A * 5/1999 Glatz et al. ..... 52/287.1
5,918,962 A * 7/1999 Nagano ..... 362/146
6,076,936 A * 6/2000 George ..... 362/146
6,082,870 A * 7/2000 George ..... 362/146
6,116,748 A * 9/2000 George ..... 362/145

* cited by examiner

*Primary Examiner*—Sandra O'Shea
*Assistant Examiner*—Ronald E. DelGizzi
(74) *Attorney, Agent, or Firm*—Gray Law Firm

(57) ABSTRACT

A step lighting apparatus comprising a coextrusion of a light reflective gray strip with a dark plastic body. The apparatus is mountable to the nose of a stair step where the reflective strip is located at the edge of the step. The strip is made from a material that will reflect low level ambient light to indicate the step's edge.

13 Claims, 3 Drawing Sheets

11
13
15
17
19
21
23
25
27
29
31
33
35
37
38
39
2

211
212
15"
40"
.122
.226
.106
.235
.102
.152
.138
.333
.172
.267
.398
.111
.312
.234
.104
.172
.237
.134
6"
12"
36"
10"
39
111
119

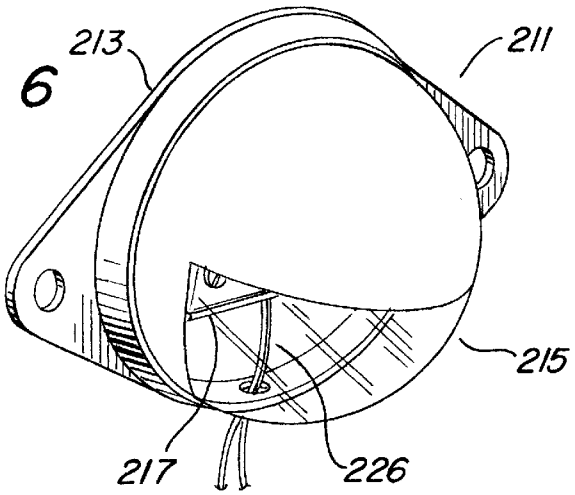
FIG. 6
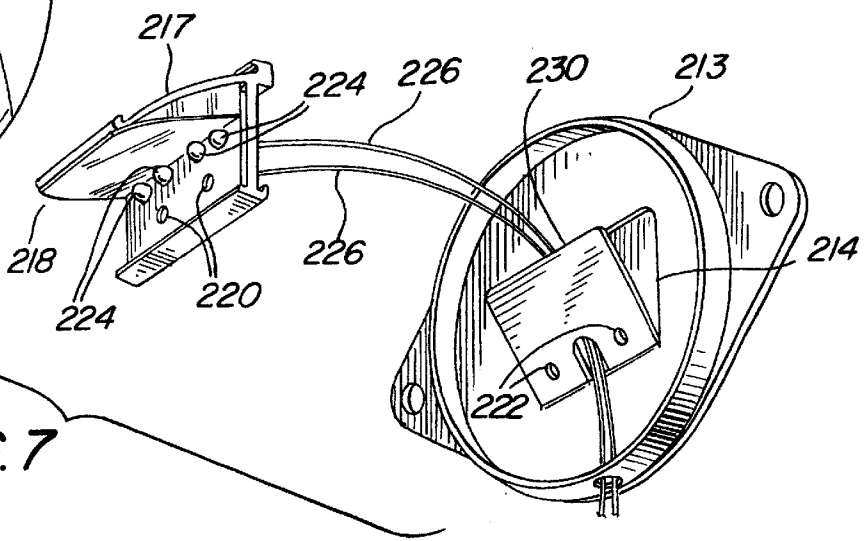
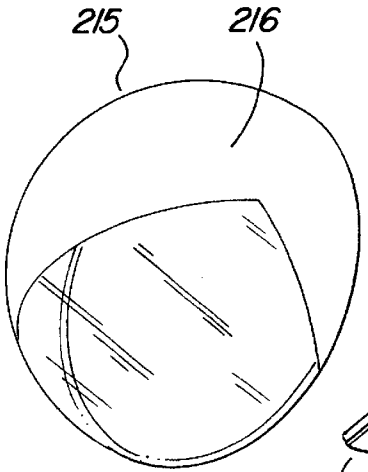
FIG. 7
FIG. 5
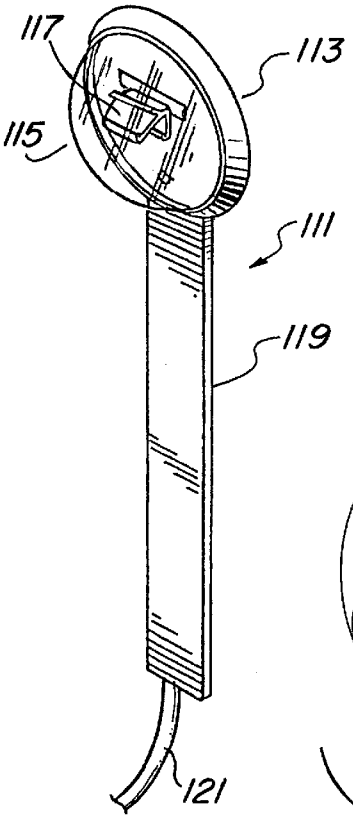

STEP ILLUMINATION APPARATUS

BACKGROUND OF THE INVENTION

1. Field of the Invention

The subject invention relates generally to lighting apparatus and more particularly to an improved step illumination fixture.

2. Description of Related Art

Various efforts have been made to improve lighting fixtures for illumination of steps in a staircase. One such effort is evidenced by U.S. Pat. No. 5,918,962 assigned to the assignee of the present application and entitled Dual Step Light and Indicator Apparatus. Such efforts have typically employed an extrusion having step and riser plate portions and electrically activated lighting devices located in the extrusion. Such lighting apparatus finds typical application in darkened theatre settings where it is desired to light the descending aisleway for patrons.

SUMMARY OF THE INVENTION

The subject invention relates to a step lighting apparatus which employs an ambient light reflective strip to alert users to the location of step edges in darkened or low light environments. Apparatus according to the invention may be conveniently used in conjunction with seat-mounted lights to provide a theatre step light fixture with no electrically activated lighting devices.

BRIEF DESCRIPTION OF THE DRAWINGS

A preferred embodiment of the just-summarized invention will now be described in detail in conjunction with the drawings, of which:

FIG. 5 is a front view of a beacon lamp unit as used in FIG. 4; and

FIGS. 6 and 7 are perspective views illustrating a preferred beacon lamp.

DETAILED DESCRIPTION OF THE PREFERRED EMBODIMENTS

Figures 1, 2, 3:
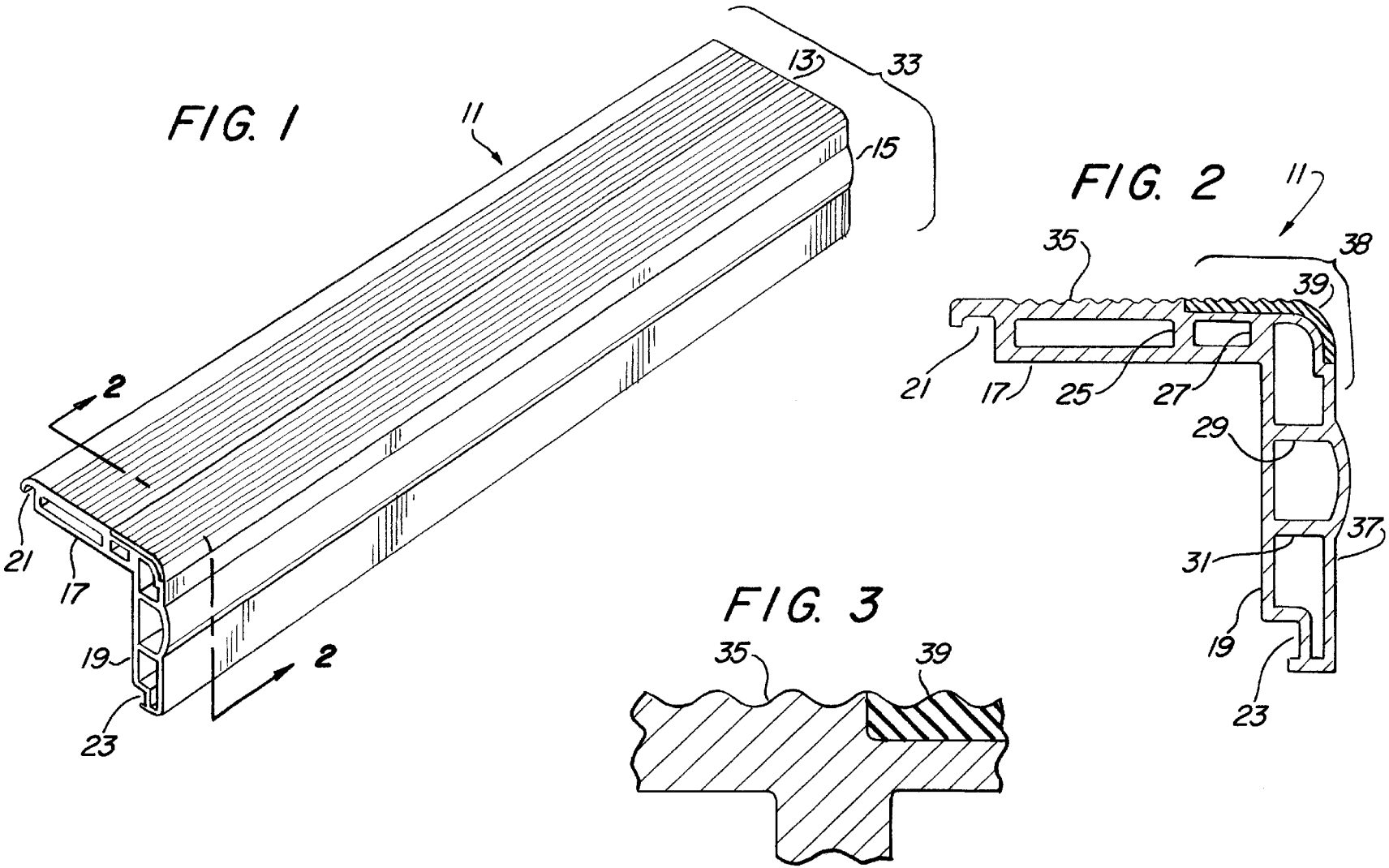
FIG. 1 is a perspective view of a lighting apparatus according to the preferred embodiment of the invention.
FIG. 2 is a cross-section taken at 2—2 of FIG. 1.
FIG. 3 is an enlarged view of a portion of FIG. 2.

The preferred lighting apparatus is illustrated in FIGS. 1–3. As shown, the apparatus includes a horizontal step plate portion 13 and a vertical riser plate portion 15. The step plate portion 13 includes a flat undersurface 17, which typically abuts the horizontal surface of a step, while the riser plate portion 15 includes a flat vertical undersurface 19 which typically mounts against the vertical riser portion of a step. The particular embodiment shown further includes respective carpet insert slots 21, 23. A number of ribs 25, 27, 29, 31 are formed between the inner surfaces 15, 17 and the outer surface 33 of the apparatus, which includes a horizontal or "tread" portion 35 and outer riser surface 37.

As further illustrated, a rounded nose portion 38 includes a light reflective layer 39, which forms a continuous outer surface with surfaces 35 and 37. In the preferred embodiment, reflective layer 39 is applied by coextrusion with the remainder of the structure. In this connection, layer 39 preferably comprises a light gray polyvinyl chloride (PVC) strip coextruded with a black or other dark PVC material to form the entire unit 11. The dark PVC may comprise 0.075 inch thick GEON C9000 (shore) black PVC plastic, while layer 39 comprises PVC material #291 as available from A&B Plastics, Yakima, Wash.

It has been discovered that when units 11 are disposed on each of the noses of a succession of stairs, the light gray coextruded strip reflects sufficient ambient light to alert users as to the location of the edges of the step without requiring the use of electrically activated light sources within the unit 11. Such light sources could of course still be employed, if desired.

Figures 4, 8:
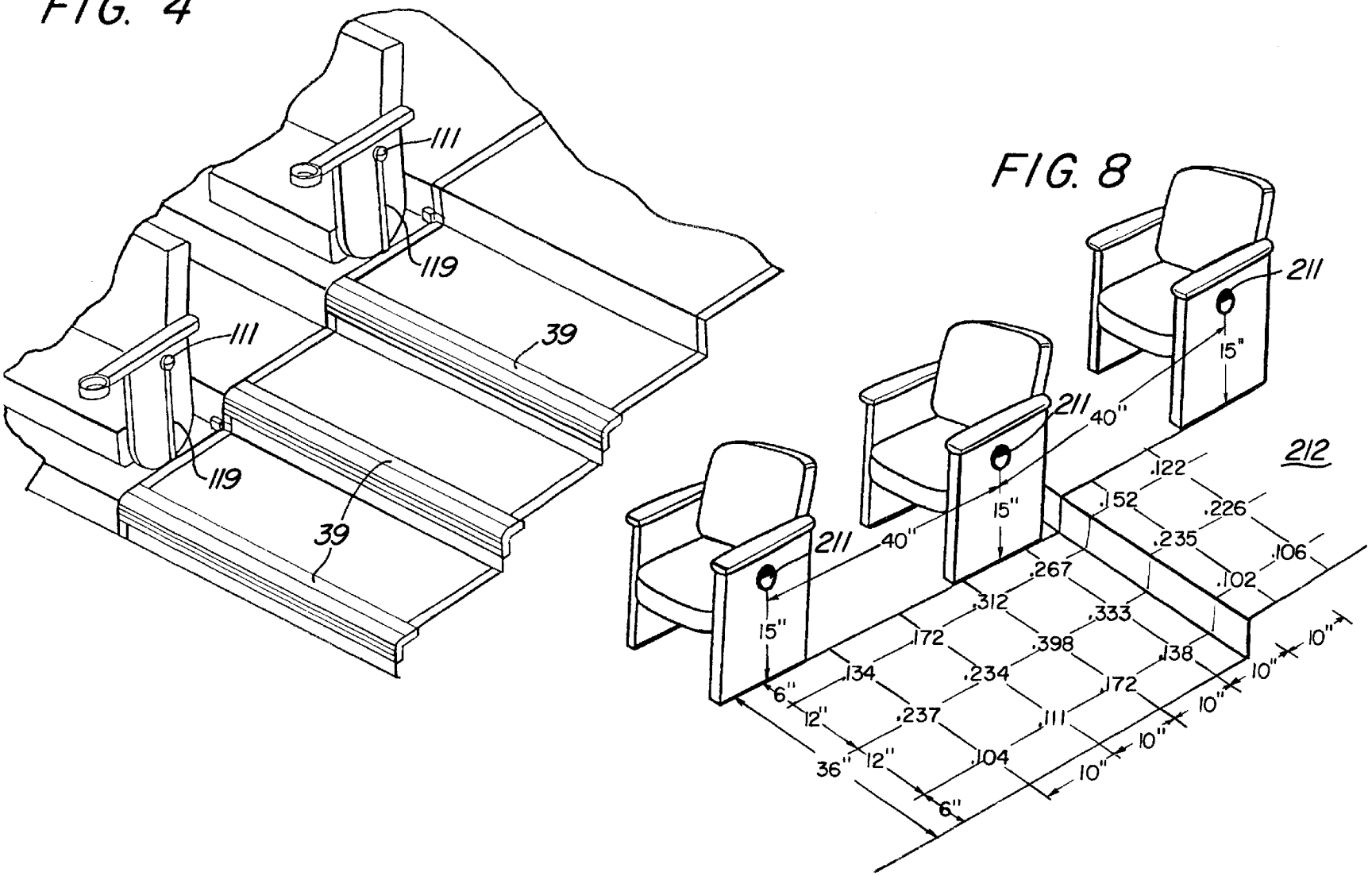
FIG. 4 is a perspective view illustrating one application of the preferred embodiment.
FIG. 8 is a perspective view illustrating a typical theatre stairway illumination pattern.

Lighting apparatus according to the preferred embodiment may advantageously be used in conjunction with seat-mounted lamps 111, as shown in FIG. 4. The seat-mounted lamps 111 may be so-called beacon lamps as shown in FIG. 5. Various constructions for beacon lamps are described in pending U.S. patent application Ser. No. 09/175,644 entitled Seat Mounted Aisle Step Light assigned to the assignee of this application and incorporated herein by reference. The particular beacon lamp embodiment shown in FIG. 5 includes a hemispherical lens 115, a circular housing 113 and a lamp holder shield 117. The particular embodiment of FIGS. 4 and 5 receives power via a feedwire 121 behind a wireway 119. Various other ways of providing power to lamps, e.g. LED's, located beneath the shield portion of lampholder shield 117 may be provided.

An alternate and presently preferred beacon lamp 211 is illustrated in FIGS. 6 and 7. The lamp 211 includes a hemispherical lens 215, the upper half 216 of which is rendered opaque by suitable coating. A housing 213 has a lampshield mounting component 214 attached thereto, e.g. welding. The component 214 includes a mounting pad 216 to which a lampholder shield 217 is attached, e.g. by screws inserted through pairs of holes 220, 222. The lampshield 217 includes a mirrored undersurface 218.

The component 214 may be formed of bendable metal such that the pad 214 can be bent to a desired angle to adjust or aim the light pattern provided by four LEDs 224 mounted in the lampholder shield 217 and powered via lead wires 226.

As may be appreciated, the lampholder shield 217 directs illumination in a manner that illuminates the side of an aisleway. An illustrative lighting pattern is shown in FIG. 8, wherein beacon lamps 211 employing four amber LEDs 224 are used on one side of an aisleway with 36" wide steps, a 6" riser and 40" pitch. The decimal numbers represent light distribution in foot candles with an average of 0.20 foot candles.

Light distributions such as shown in FIG. 8 typically will not clearly illuminate the edges of steps down the aisleway. The obscurity of the edge of the steps is particularly pronounced with LED light sources because the light is monochromatic and does not produce a great deal of contrast. Provision of step-mounted fixtures such as shown in FIGS. 1–3 provide a means of capturing and reflecting low level ambient light to provide clear demarcation of the step edges. The effect created is particularly striking and surprising to the observer. Thus, in a lighting system such as shown in FIG. 4, respective reflective layers 39 of the units 11 respond to relatively low-intensity or low-level ambient light generated by the beacon lamps 111 to render the strips 39 visible in the dark to persons traveling the staircase.

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A lighting apparatus comprising:

a first extruded portion shaped to mount on the nose of a stair step; and, a second extruded portion coextruded with said first portion and mounted on top of the first portion so as to be above the nose of the stair step, said second portion comprising a material inert to light and selected to have a reflectance factor greater than or equal to light gray polyvinyl chloride.

2. The apparatus of claim 1 wherein said first portion and second portion each comprise a plastic material.

3. The apparatus of claim 1 wherein said second portion comprises a strip positioned by said first portion to be disposed along the edge of a step.

4. A lighting apparatus comprising:

a first extruded portion shaped to mount on the nose of a stair step; and, a second extruded portion coextruded with said first portion, said second portion having a light gray polyvinyl chloride strip positioned by said first portion to be disposed along the edge of the stair step.

5. The apparatus of claim 4 wherein said strip comprises PVC material #291 as available from A&B Plastics.

6. A lighting apparatus mountable in connection with a step of a staircase and comprising:

a first plastic extruded portion providing a step plate surface and a riser surface mounted at a right angle with respect to one another and dimensioned to be mounted on a nose portion of a stair step;

a second plastic light reflective strip made from a material that is inert to light and coextruded with said first portion, located so as to be disposed at and visible along an edge of said step; and, a lamp mounted on a portion of a seat, said seat being located adjacent to said step, where the lamp is positioned to cast light on the second plastic light reflective strip for reflection by the strip.

7. The apparatus of claim 6 wherein said lamp includes at least one LED arranged to illuminate said step.

8. The apparatus of claim 6 wherein said lamp includes a plurality of LEDs located beneath a shield, the shield being shaped and disposed to direct light from said plurality of LEDs onto said step.

9. A lighting apparatus comprising:

a first extruded portion shaped to mount on a nose of a stair step; and, a second strip portion coextruded with said first portion from a reflective material inert to light; said strip mounted on top of the first portion and located so as to be disposed at and visible along an edge of said step in a darkened environment without connecting the strip to a power source.

10. The lighting apparatus of claim 9 further including a lamp mounted on a portion of a seat, said seat being located adjacent to said step.

11. The lighting apparatus of claim 9 wherein said lamp includes at least one LED arranged to illuminate said step.

12. The lighting apparatus of claim 9 wherein said lamp includes a plurality of LEDs located beneath a shield, the shield being shaped and disposed to direct light from said plurality of LEDs onto said step.

13. A lighting apparatus comprising:

a first extruded component shaped to mount on the nose of a stair step, said first component is made from a material inert to light and selected to have a reflectance factor less than light gray polyvinyl chloride;

a second extruded component coextruded with said first component and mounted on the first component above the nose of a stair step; said second component comprising a material inert to light and selected to have a reflectance factor greater than or equal to light gray polyvinyl chloride; and, a lamp mounted above the second component such that light from the lamp is directed to the second component and reflected by the second component so that the nose of the stair step is illuminated by the second component.

* * * * *

US006554446C1

(12) INTER PARTES REEXAMINATION CERTIFICATE (1165th)

United States Patent
Walsh et al.

(10) Number: US 6,554,446 C1
(45) Certificate Issued: Sep. 14, 2015

(54) STEP ILLUMINATION APPARATUS

(75) Inventors: Terrence C. Walsh, Coto de Caza, CA (US); Randy G. Valparaiso, Whittier, CA (US)

(73) Assignee: TIVOLI, LLC, Santa Ana, CA (US)

Reexamination Request:
No. 95/000,067, Dec. 20, 2004

Reexamination Certificate for:

| | |
|---|---|
| Patent No.: | **6,554,446** |
| Issued: | **Apr. 29, 2003** |
| Appl. No.: | **09/476,951** |
| Filed: | **Jan. 3, 2000** |

(51) Int. Cl.

| | |
|---|---|
| ***F21S 8/00*** | (2006.01) |
| ***F21S 4/00*** | (2006.01) |
| ***E04F 11/16*** | (2006.01) |
| ***F21V 33/00*** | (2006.01) |
| *E04F 11/104* | (2006.01) |
| *F21W 111/027* | (2006.01) |

(52) U.S. Cl.
CPC ..... *F21S 4/008* (2013.01); *E04F 11/166* (2013.01); *F21S 8/032* (2013.01); *F21V 33/006* (2013.01); *E04F 2011/1048* (2013.01); *F21W 2111/027* (2013.01); *Y10S 362/80* (2013.01)

(58) Field of Classification Search
USPC ..... 362/146, 131, 145, 800, 282; 52/179, 52/182
See application file for complete search history.

(56) References Cited

To view the complete listing of prior art documents cited during the proceeding for Reexamination Control Number 95/000,067, please refer to the USPTO's public Patent Application Information Retrieval (PAIR) system under the Display References tab.

*Primary Examiner* — Sara Clarke

(57) ABSTRACT

A step lighting apparatus comprising a coextrusion of a light reflective gray strip with a dark plastic body. The apparatus is mountable to the nose of a stair step where the reflective strip is located at the edge of the step. The strip is made from a material that will reflect low level ambient light to indicate the step's edge.

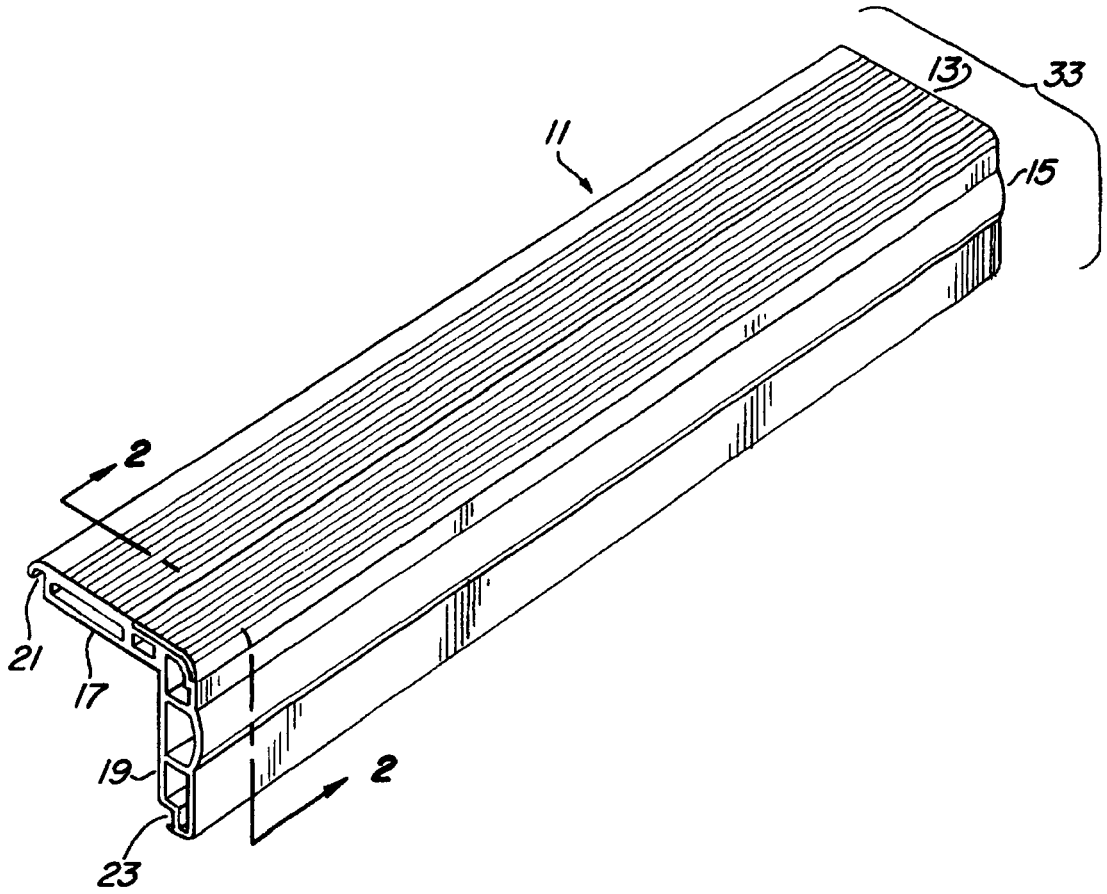

INTER PARTES REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-13 are cancelled.

* * * * *